United States Patent [19]

Brownly

[11] 4,208,812

[45] Jun. 24, 1980

[54] SNOW PLOW ATTACHMENT

[75] Inventor: Richard C. Brownly, Troy, N.H.

[73] Assignee: Norman S. Blodgett, Worcester, Mass.

[21] Appl. No.: 914,846

[22] Filed: Jun. 12, 1978

[51] Int. Cl.[2] ..... E01H 5/00

[52] U.S. Cl. ..... 37/41; 172/784

[58] Field of Search ..... 37/41, 42 R, 50; 172/784, 777

[56] References Cited

U.S. PATENT DOCUMENTS

| | | | |
|---|---|---|---|
| 2,964,862 | 12/1960 | Lotz | 37/50 X |
| 2,988,831 | 6/1961 | Burns | 37/50 |
| 3,055,126 | 9/1962 | Emhof | 37/42 R |
| 3,208,166 | 9/1965 | Proulx | 37/42 R |
| 3,373,515 | 3/1968 | Schneider | 37/50 |
| 3,374,562 | 3/1968 | Glesmann | 37/50 |
| 3,407,519 | 10/1968 | Batko | 37/42 R |
| 3,411,590 | 11/1968 | Batko | 172/777 |
| 3,703,210 | 11/1972 | Williams | 172/784 |
| 4,077,139 | 3/1978 | Fagervold | 37/41 |

FOREIGN PATENT DOCUMENTS

| | | | |
|---|---|---|---|
| 539486 | 4/1957 | Canada | 37/50 |
| 746657 | 11/1966 | Canada | 37/50 |

*Primary Examiner*—E. H. Eickholt

*Attorney, Agent, or Firm*—Norman S. Blodgett; Gerry A. Blodgett

[57] ABSTRACT

Hydraulically-actuated snow plow attachment swingable in a vertical plane on occasion to a lowered position at which it inhibits lateral flow of snow.

7 Claims, 4 Drawing Figures

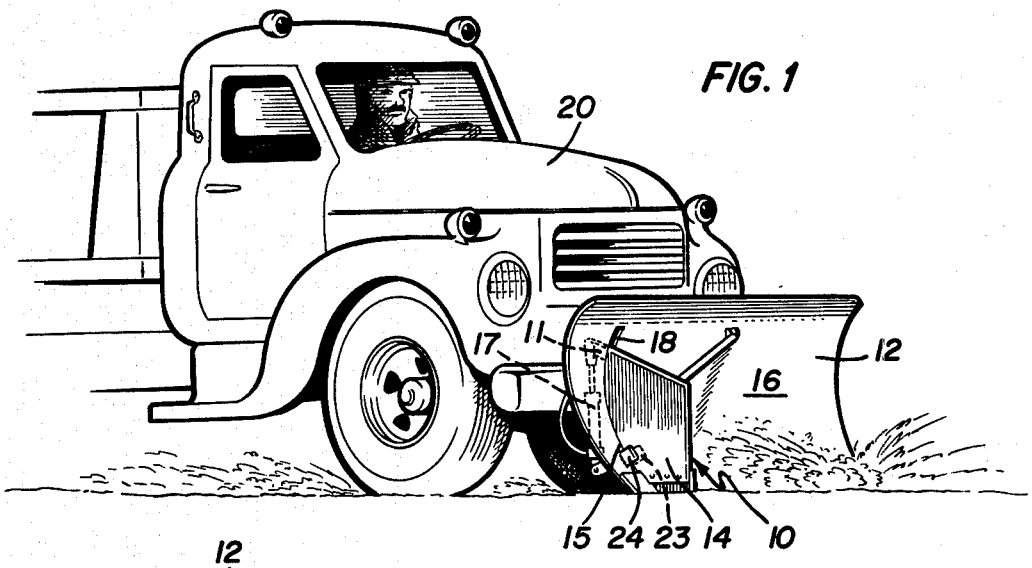
FIG. 1
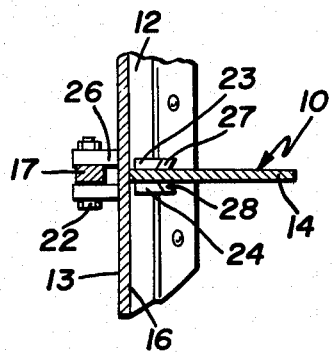
FIG. 4
FIG. 2
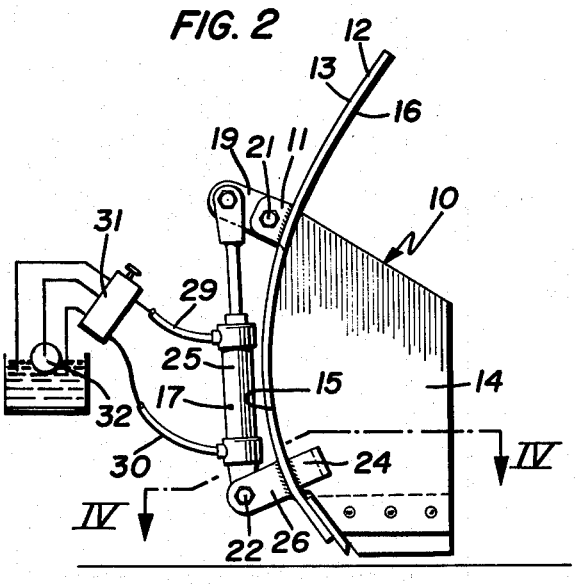
FIG. 3
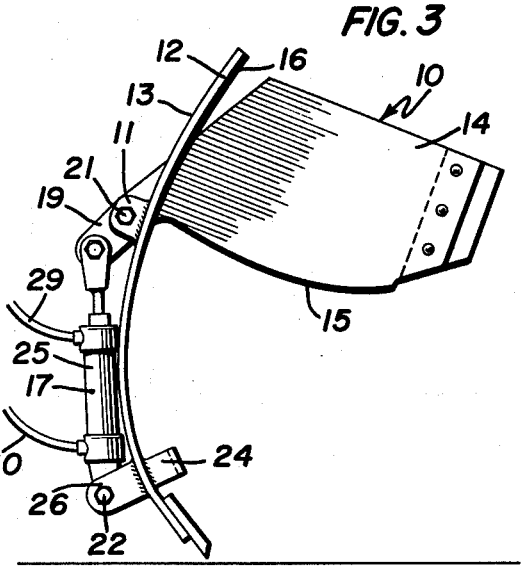

SNOW PLOW ATTACHMENT

BACKGROUND OF THE INVENTION

One of the accepted methods of removing snow from a roadway or street is by the use of a plow attached to the front end of a vehicle. The plow is normally inclined or canted to the direction of motion of the vehicle and, therefore, snow is caused to cam or slide along the front surface of the plow in a lateral direction. While this action can take place almost as fast as the vehicle is able to proceed along the street, there are, nevertheless, some deficiencies to the method. The greatest problem is that a snow plow tends to "store" a certain amount of snow along its length, which supply of snow continues to flow off the "downstream" end of the plow even after the plow has left an area in which snow can be collected. The most visible result of this action is that a windrow of snow is deposited across the entrance to cross streets and driveways. It is then necessary to remove this ridge of snow by hand. It is particularly disconcerting to a homeowner who has recently shoveled out his driveway to have a new ridge of snow placed across its entrance from time-to-time. The complaints about this matter are one of the more pressing problems encountered in operating a municipal highway department, particularly during the winter time. These and other difficulties experienced with the prior art devices have been obviated in a novel manner by the present invention.

It is, therefore, an outstanding object of the invention to provide a snow plow attachment which prevents windrowing of snow across lateral streets and across the entrances to driveways.

Another object of this invention is the provision of an attachment for a snow plow which can be controlled remotely for movement from operative to inoperative positions.

A further object of the present invention is the provision of an attachment for inhibiting snow flow, which attachment may be readily connected to pre-existing snow plow apparatus.

It is another object of the instant invention to provide a snow plow attachment which is simple and rugged on construction, which may be readily manufactured, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a snow plow attachment having a hinge element adapted to be attached to the rear surface of a snow plow blade. A plate-like baffle is attached to the hinge means, the baffle having one edge shaped to conform to the forwardly-directed concave surface of the snow plow blade. An actuator is attached to the baffle to rotate it about the hinge means in a vertical plane from a first lowered position in which the said one edge of the baffle lies against the said forwardly-directed surface of the blade to prevent movement of snow there-across to a second raised position in which the said one edge is substantially removed from the surface of the blade.

More specifically, the snow plow blade is provided with a vertical slot and the baffle is provided with a rearwardly-directed tab that extends through the slot to the rear of the blade for attachment to the hinge element. The tab extends rearwardly of the hinge axis a substantial distance and is attached to one end of the actuating means. A pair of spaced pegs is attached to the said forwardly-directed surface of the blade to receive, embrace, and support the baffle when it is in its lowered position.

BRIEF DESCRIPTION OF THE DRAWINGS

The character of the invention, however, may be best understood by reference to one of its structural forms, as illustrated by the accompanying drawings, in which:

FIG. 1 is a perspective view of an attachment embodying the principles of the present invention shown in use with a vehicle with a snow plow, FIG. 2 is a side elevational view of the invention in a first mode, FIG. 3 is a side elevational view of the invention showing it in a different mode, and FIG. 4 is a horizontal sectional view of the invention taken on the line IV—IV of FIG. 2.

DESCRIPTION OF THE PREFERRED EMBODIMENT

Referring first to FIG. 1, wherein are best shown the general features of the invention, the snow plow attachment, indicated generally by the reference numeral 10, is shown as including a hinge element 11 attached to the rear surface of a snow plow blade 12. Attached to the hinge element 11 is a plate-life baffle 14 having one edge 15 conforming to the concave shape of the forwardly-directed surface 16 of the snow plow blade. The blade 12 is mounted in the usual manner on the front end of a vehicle 20 for pivotal movement by the usual means, including hydraulic cylinders, not shown. An actuator 17 is located adjacent the rearwardly-directed surface 13 of the blade and is connected to the baffle 14 to rotate it about the hinge element in a vertical plane from a first, lowered position (in which the edge 15 lies against the forwardly-directed surface 16 of the blade to prevent movement of snow there-across) to a second, raised position in which the said one edge of the baffle is substantially removed from the surface of the plow.

The snow plow blade 12 is provided with a vertical slot 18 and the baffle 14 has a rearwardly-directed tab 19 that extends through the slot 18 to the rear of the blade for attachment to the hinge element 11. The tab is connected to the hinge element by a hinge pin 21 located slightly rearwardly of the rear surface 13 of the blade and the tab extends further rearwardly of the hinge pin to a point that is spaced a substantial distance therefrom. It is connected to one end of the actuator 17 by a pin 22 at that point.

A pair of spaced pegs 23 and 24 is attached to the forwardly-directed surface 16 of the blade 12 to receive, embrace, and support the baffle 14 when it is in the said first, lowered position. The actuator 17 is a hydraulic cylinder 25, the lower end of which is fastened to a lower hinge element 26 which is fixed to the rear surface 13 of the blade. The two hinge elements 11 and 26 are spaced vertically a substantial distance. The pegs 23 and 24 are located on the forwardly-directed surface of the blade at the same general vertical level as the lower hinge element 26. As is evident in FIG. 4, the pegs 23 and 24 have facing surfaces 27 and 28, respectively, that are beveled to assist the entrance of the edge 15 of the baffle therebetween. The cylinder 25 of the actuator 17 is provided with hoses 29 and 30 which are, in turn, connected through a valve 31 to the pump 32 of a hydraulic system of the conventional type. This would usually be the hydraulic system that provides the plow 12 with its operating fluid under pressure.

The operation and the advantages of the present invention will now be readily understood in view of the above description. When the vehicle 20 proceeds in a forwardly direction, its motor operates the pump 32 to provide hydraulic fluid both for the attachment 10 and for the snow plow 20. When not in use, the baffle 14 is in the raised position shown in FIG. 3, where it does not inhibit in any way the operation of the snow plow. As the vehicle proceeds along the right-hand side of the street, plowing to the right, the snow plow 12 would be inclined to the right to force snow in the right-hand side of the vehicle onto the side of the road. As a cross street or driveway is approached, the operator actuates the valve 31 to energize the cylinder 25 of the actuator 17. This causes the actuator to expand from the position shown in FIG. 3 to the position shown in FIG. 2, thus pivoting the baffle 14 about the hinge pin 21 of the hinge element 11. The actuator operates in this way until the edge 15 of the baffle 14 contacts the forwardly-directed surface 16 of the blade. This edge is formed in such a way as to conform closely to the blade surface. As the baffle 14 approaches the lower position shown in FIG. 2, it enters the beveled surfaces 27 and 28 of the pins 23 and 24, respectively, and is closely embraced and supported between them. Snow which has accumulated on the snow blade is prevented from flowing across the blade and from being deposited in a window across the entrance to the cross street or the driveway. When the vehicle has safely passed the entrance to the driveway, the actuator is energized in the other direction by means of the valve 31 and the baffle 14 is lifted into the air, so that the snow plow can operate in the usual way. It can be seen, then, that it is possible for the operator of the vehicle to store the snow accumulated just ahead of any entrance to a driveway. This is the situation that is desired by most homeowners and it also does away with the necessity of performing clean-up work at cross streets.

It is obvious that minor changes may be made in the form and construction of the invention without departing from the material spirit thereof. It is not, however, desired to confine the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Snow plow attachment, comprising:

(a) a hinge element adapted to be attached to the rear surface of a snow plow blade, (b) a plate-like baffle attached to the hinge element, the baffle having one edge adapted to conform to the shape of the forwardly-directed surface of the snow plow blade, and (c) an actuator connected to the baffle to rotate it about the hinge element in a vertical plane from a first lowered position in which the said one edge of the baffle lies against the said forwardly-directed surface of the blade to prevent movement of snow there across to a second raised position in which the said one edge is substantially removed from the surface of the blade, the snow plow blade being is provided with a vertical slot, and the baffle being provided with a rearwardly-directed tab that extends through the slot to the rear of the blade for attachment to the hinge element, the tab being connected to the hinge element by a hinge pin, and the tab extending rearwardly of the hinge pin to a point that is spaced a substantial distance therefrom and is connected to one end of the actuator by a pin at that point.

2. Snow plow attachment as recited in claim 1, wherein a pair of spaced pegs is attached to the said forwardly-directed surface of the blade to receive, embrace, and support the baffle when it is in the said first lowered position.

3. Snow plow attachment as recited in claim 1, wherein the actuator is a hydraulic cylinder, and wherein the other end of the actuator is fastened to a lower hinge element fixed to the rear surface of the blade.

4. Snow plow attachment as recited in claim 2, wherein the two hinge elements are vertically spaced by a substantial distance.

5. Snow plow attachment as recited in claim 3, wherein the pegs are located on the forwardly-directed surface of the blade at the same general vertical level as the lower hinge element.

6. Snow plow attachment as recited in claim 4, wherein the pegs have facing surfaces that are beveled to assist entrance of the said edge of the baffle therebetween.

7. Snow plow attachment, comprising:

(a) a hinge element adapted to be attached to the rear surface of a snow plow blade provided with a vertical slot, (b) a plate-like baffle attached to the hinge element, the baffle having one edge adapted to conform to the shape of the forwardly-directed surface of the snow plow blade, said baffle being provided with a rearwardly-directed tab that extends through said vertical slot to the rear of the blade for pivotal attachment to the hinge element, and (c) an actuator operatively connected to the tab for rotating the baffle about the hinge element in a vertical plane from a first lowered position in which the said one edge of the baffle lies against the said forwardly-directed surface of the blade to prevent movement of the snow thereacross to a second raised position in which the said one edge is substantially removed from the surface of the blade.

* * * * *